US006103097A

United States Patent [19]

Russell

[11] Patent Number: 6,103,097

[45] Date of Patent: Aug. 15, 2000

[54] METHOD AND APPARATUS FOR LEAD CONTAMINATION CONTROL

[76] Inventor: Larry L. Russell, 200 Martinique Ave., Tiburon, Calif. 94920

[21] Appl. No.: 09/160,825

[22] Filed: Sep. 25, 1998

Related U.S. Application Data

[60] Provisional application No. 60/060,404, Sep. 30, 1997.

[51] Int. Cl.[7] ..... C23F 13/00

[52] U.S. Cl. ..... 205/724; 205/730; 205/733; 205/738; 205/740; 204/196.01; 204/196.04; 204/196.11; 204/196.15; 204/196.26; 204/196.37; 204/196.38; 204/196.16

[58] Field of Search ..... 205/724, 730, 205/733, 738, 740; 204/196.01, 196.04, 196.11, 196.15, 196.26, 196.37, 196.38, 196.16

[56] References Cited

U.S. PATENT DOCUMENTS

| | | | |
|---|---|---|---|
| 1,842,541 | 1/1932 | Cumberland . | |
| 3,689,395 | 9/1972 | Blount et al. | 204/196.16 |
| 4,457,821 | 7/1984 | Sudrabin et al. | 204/196.37 |
| 4,826,577 | 5/1989 | Lange | 204/1 T |
| 4,855,029 | 8/1989 | Gazda et al. | 204/196.16 |
| 4,975,560 | 12/1990 | Wardy | 219/322 |
| 4,990,231 | 2/1991 | Stewart et al. | 204/196.38 |
| 5,006,214 | 4/1991 | Burchnell et al. | 204/196.16 |

*Primary Examiner*—Bruce F. Bell
*Attorney, Agent, or Firm*—Limbach & Limbach LLP

[57] ABSTRACT

Control of lead contamination in residential water supplies is accomplished by cathodic protection of lead-containing piping and lead-containing fixtures. Specifically, a partially insulated wire is inserted into lead-containing service lateral piping. Application of a DC current to the partially insulated wire causes the wire to act as an anode and transforms the walls of the pipe into the cathode, thereby protecting against corrosion. Alternatively, a sacrificial anode is inserted into a lead-containing fixture. The electrical potential generated by corrosion of this sacrificial anode transforms the walls of the fixture into a cathode, thereby preventing corrosion. Carbonate scaling built-up prior to the initiation of cathodic protection may be removed by temporarily blocking the water pipe and introducing cleaning chemicals.

17 Claims, 3 Drawing Sheets

METHOD AND APPARATUS FOR LEAD CONTAMINATION CONTROL

CROSS-REFERENCE TO RELATED APPLICATION(S)

This application claims priority based upon the United States provisional patent application Ser. No. 60/060,404 entitled "Method and Apparatus for Lead Contamination Control", filed Sep. 30, 1997, inventor Larry Russell.

BACKGROUND OF THE INVENTION

1. Field of the Invention

The present invention relates to control of lead contamination in drinking water supplies, and more particularly, to cathodic protection of lead-containing piping and fixtures from corrosion.

2. Description of the Related Art

For thousands of years, lead has been used to fabricate piping for residential water supplies. Lead is useful for this purpose mainly because of its wide availability, and the relative ease of molding lead into pipes and junctions having desired shapes and sizes.

Because of these characteristics, lead was commonly used in water piping as recently as 1956 in Japan and even into the mid 1960's in Europe. The use of lead-containing piping was particularly common in "service lateral" pipes that connect residences to larger municipal water mains. Even today, lead faucets and fixtures advertised in the United States as being "lead free" can actually contain as much as 8% lead.

The human health hazard posed by lead ingestion is now widely recognized. Lead is a poisonous substance. Intake of even small amounts of lead on a regular basis can cause headaches, dizziness, and insomnia. Ingestion of acute doses of lead can cause stupor, which progresses to coma and then death. There is general agreement among the scientific community that the desirable concentration of lead in drinking water is zero, and the U.S. E.P.A. standard is 15 parts per billion (ppb). The World Health Organization (WHO) Drinking Water Directive (DRD) for lead is 10 ppb.

Recognition of the dangers posed by lead in drinking water supplies has led water authorities in the United States to replace lead-containing piping with substitutes formed from plastic or copper metals. However, domestic water supplied by piping containing lead or lead soldering remains in place in many older homes and in locations throughout the world.

The American Water Works Association has estimated that as of 1990, there were 6.4 million lead goose neck service connections and 3.3 million lead service lines in the United States. It is also estimated that there are over 15 million lead service lines remaining in Europe. It has been estimated that removal and replacement of lead service laterals in Europe will cost over EU $ 50 billion (US $ 61 billion).

Current technology for the control of lead contamination involves options such as removal and relining of pipes, or performing adjustments in water chemistry such as modification of pH and alkalinity and addition of proprietary chemicals. Unfortunately however, these water chemistry adjustments require diligent control and are not effective when a standard of 10 ppb is required, due to the complex chemistry of lead corrosion and dissolution.

The primary known means for lead solubility control are pH adjustment, remineralization, adjustment of alkalinity and addition of phosphate salts. Existing methods for removal of lead in water have focused upon industrial contamination sources having large water flows that contain relatively high lead concentrations. Methods used to treat such large scale contamination include exposure of the contaminated water to biological and chemical agents, or treatment of the water with specialized electrochemical apparatuses. However, these methods are usually complex, require expensive machinery and are typically feasible only for large scale lead contamination. Moreover, it is not feasible to perform these sophisticated treatments at the point of use, such as is required given that the lead contamination comes from the water distribution system itself.

Therefore, where lead-containing residential water piping is still used for service laterals and/or where lead containing water fixtures are present, there is a need in the art for simple and inexpensive apparatuses and methods that permit lead contamination control of existing water pipe configurations having relatively small water flow volumes and low lead concentrations.

SUMMARY OF THE INVENTION

The present invention provides simple and inexpensive methods and apparatuses for control of lead contamination in residential water supplies.

In accordance with the apparatuses and methods of the present invention, an element is introduced within the interior of a lead-containing water vessel. The inserted element bears sufficient electrical potential that the inserted element, rather than the walls of the water vessel, serve as an anode. Because corrosion occurs only at the anode, the walls of the lead-containing pipes or fixtures are transformed into a cathode and are thereby prevented from corroding and contaminating the water flow.

In accordance with a first embodiment of the present invention, direct electrical current is applied to a partially insulated wire inserted within the lead piping. Application of an impressed DC current to the inserted wire results causes the potential of the lead piping to be lowered at least below about −0.3 V.

Alternatively, or in conjunction with the first embodiment, a second embodiment of the present invention teaches placement of a sacrificial anode into lead-containing faucets or fixtures. Natural corrosion of the sacrificial anode in the water causes the electrical potential at the walls of the piping to be lowered at least below about −0.3 V.

As a consequence of corrosion, lead carbonate may also form on the interior of piping in the form of scales. This lead carbonate is nonconductive and can thus interfere with cathodic protection. Moreover, the lead carbonate is water soluble and harmful if ingested. Therefore, lead carbonate scaling should be removed prior to implementation of the cathodic protection of the present invention. Accordingly, it is a further aspect of the present invention to remove accumulated scaling by temporarily plugging the water pipe and introducing a cleaning agent into the pipe. After the scaling has been removed by the cleaning agent, the pipe is flushed with water and the lead filtered from the waste water. The filtered waste water is then routed to a sewer line.

The features and advantages of the present invention will be understood upon consideration of the following detailed description of the invention and the accompanying figures.

DETAILED DESCRIPTION

The present invention provides simple and inexpensive methods and apparatuses for control of lead contamination in residential water supplies. In particular, the present invention teaches cathodic protection of lead-containing water piping or water fixtures from corrosion.

Corrosion of the lead-containing walls of water conduits is an electrochemical process. During corrosion, electrical charge builds up at localized regions on the walls of the water vessel. These localized regions are transformed into anodes, where lead metal is transformed into lead oxide or other semi-water soluble species. The lead oxide then physically separates from the surrounding lead metal and is swept into the water flow, where lead is solubilized in ionic form.

Corrosion occurs only at the anode of an electrochemical system. The technique of cathodic protection teaches the introduction of a voltage to a structure other than the element sought to be protected from corrosion. Where this voltage is greater than the corrosion potential of the protected element, the protected element functions as the cathode of the system rather than as the anode. Because the protected element is serving as the cathode, the protected element does not corrode.

Figure 1:
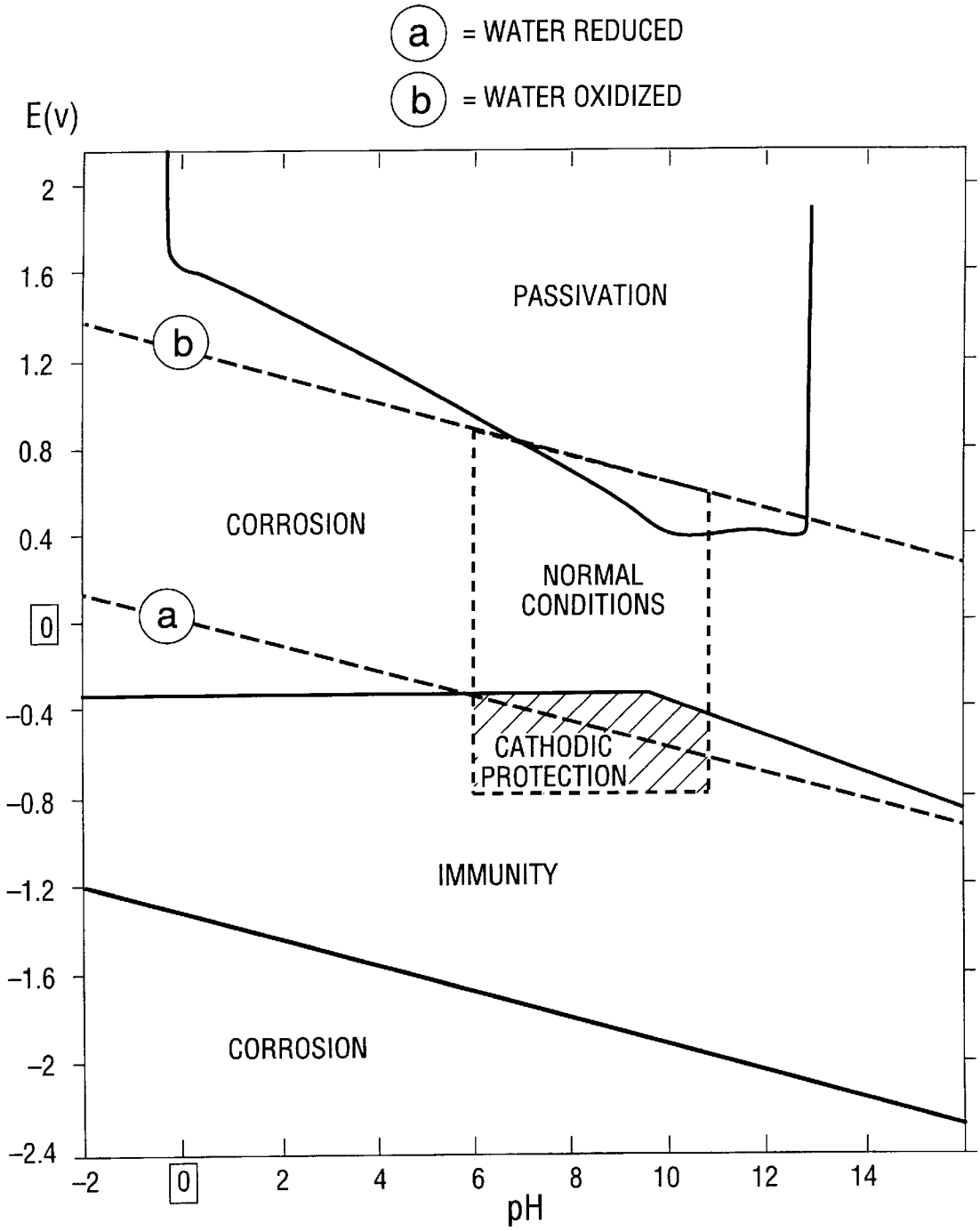
FIG. 1 shows a Pourbaix diagram which plots theoretical conditions of corrosion, immunity and passivation of lead in water at 25° C., in the absence of substances forming insoluble salts.

FIG. 1 shows a Pourbaix diagram which plots theoretical conditions of corrosion, immunity and passivation of lead in water at 25° C., in the absence of substances forming insoluble salts. The ideal operating conditions for the cathodic protection of lead are in the range of between about 0.3 and 0.8 V, and the normal pH of the water is in the range of 7–10 in the zone labeled "Immunity". As can be seen by impressing a voltage of between about −0.3 and −0.8 V in this "Immunity" zone, lead remains uncorroded under normal water pH conditions.

State of the art water treatment processes have been recognized to achieve a lead concentration of approximately 25 $\mu$g/l after the water stands for six hours (the normal stagnation period required to achieve maximum lead concentration). Cathodic protection can easily further inhibit corrosion such that this level of contamination is less than 5 $\mu$g/l.

As described above, in accordance with the present invention a sufficient negative voltage (at least approximately −0.3 V, and preferably between −0.3 and −0.8 V) must be introduced at the lead surface in order to cause immunity to be achieved. Current density must be maintained on the order of 1 mA/ft$^2$ (10 $\mu$A/cm$^2$) per exposed lead-containing surface area, which is sufficient to protect this surface area from corrosion (oxidation).

Cathodic protection of water vessels according to the invention may be accomplished in several ways. In accordance with the first embodiment of the present invention, a partially insulated wire is introduced within the interior of lead-containing piping. Application of an impressed DC current to this wire causes sufficient electrical potential to appear on the wire to transform it into an anode and the lead walls of the water piping into a cathode. This halts corrosion at the walls, and prevents water quality degradation due to lead solubilization.

Figure 2:
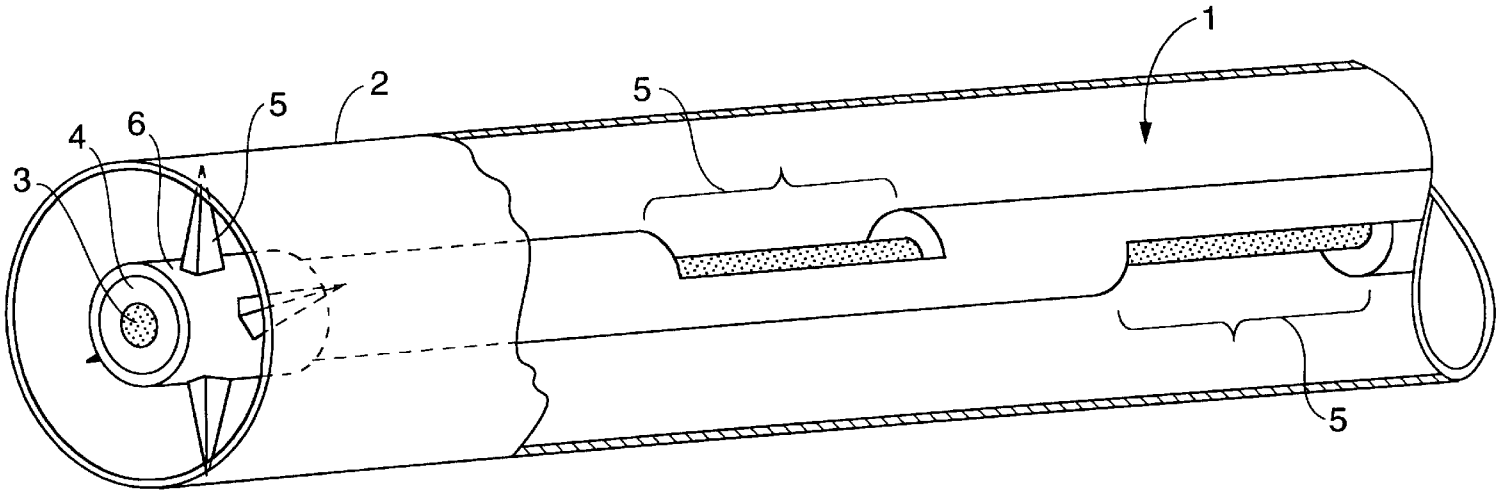
FIG. 2 shows an apparatus for lead control via in situ cathodic protection of lead piping in accordance with a first embodiment of the present invention.

FIG. 2 illustrates lead control via in situ cathodic protection in accordance with a first embodiment of the present invention. Lead control device 1, consisting of wire 3 partially encased by insulation 4, is inserted within pipe 2. Pipe 2 is either composed entirely of lead that is subject to corrosion and solubilization, or is assembled from components utilizing lead-containing solder. Lead contamination is present in the form of charged lead ions dissolved in water.

Lead corrosion along pipe 2 occurs because of the effects of the natural solubility of lead in water, and natural, localized electrochemical potentials located within the piping itself. By the nature of the cathodic protection utilized by the present invention, connection of wire 3 to a DC electrical potential forms an electrical circuit through the water and the current is carried to protect the entire pipe along the length of wire 3. Water within pipe 2 acts as the second leg of the circuit to protect the lead-containing service lateral. Thus, applying an electrical potential to the water flowing through the pipe—via the wire in the water—serves to halt corrosion stemming from the naturally-occurring localized electrical potentials on the lead pipe.

In accordance with a preferred embodiment of the present invention, lead solubility control device 1 includes a wire 3 of gauge twenty-two or larger. Wire 3 may be composed of a variety of materials, with platinum being preferred. However, any noble metal resistant to dissolution in water would also be suitable. Silver-plated copper, titanium-plated platinum, or a number of other metal or metal combinations could be utilized.

Wire 3 is intermittently encased by electrically insulating material 4. Electrically insulating material 4 may be polyethylene or another suitable water-insoluble, flexible, and non-conducting compound. Exposed portion 5 of wire 3 suitably constitutes approximately fifty percent of the length of wire 3, with the opening in insulation 4 alternating on either side of wire 3. Wire 3 encased within insulation 4 and spacer end portion 6 should be of small enough gauge to permit insertion even if lead-containing service lateral 10 has partly collapsed, as often happens during installation.

Application of an impressed DC current to wire 3 causes sufficient voltage to appear on wire 3 that the walls of pipe 2 are cathodically protected and lead solubility is minimized. A typical current density utilized for this purpose is 1 mA/ft$^2$ (10 $\mu$A/cm$^2$) of interior surface area of lead piping.

The design of the wire anode to be inserted into the pipe is critical in that it must be both flexible and yet sufficiently rigid to be inserted within the lateral which may be misaligned. To provide cathodic protection, sufficient negative voltage (at least about −0.3 V DC, and preferably between −0.3 and −0.8 V DC) must be impressed at the lead surface for immunity to be achieved. Current density must be maintained on the order of 1 mA/ft$^2$ (10 $\mu$A/cm$^2$), which is sufficient to protect the lead surface from corrosion (oxidation).

Due to the fact that the length of the anode is short, the wire can be of a relatively small diameter (22 gauge or larger, and preferably between 16–18 gauge), as the electrical resistance is low and the voltage drop will be minimal. The distance that the anode is effective (known as the "throw") is more than sufficient to ensure protection of the 2–4 cm lateral pipe diameters normally encountered in domestic water systems. The wire does not have to be centered in the pipe, as the "throw" is sufficient to protect the entire interior of the pipe.

Figure 3:
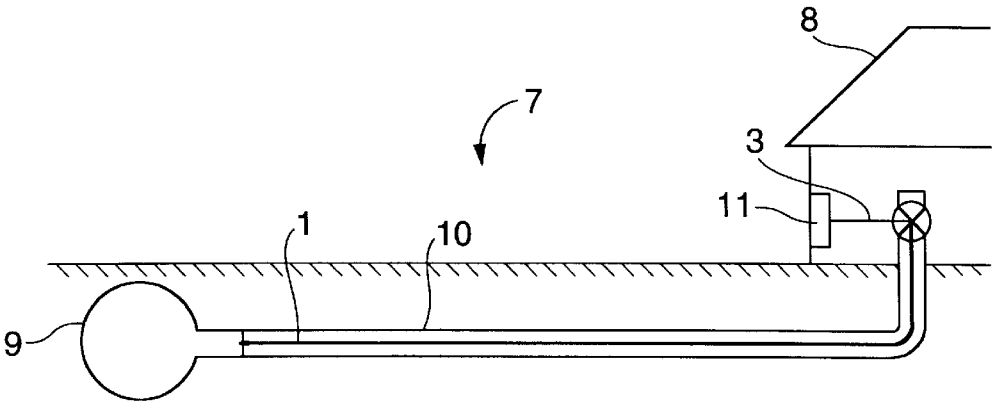
FIG. 3 shows a typical residential drinking water distribution system equipped with a lead solubility control apparatus in accordance with the first embodiment of the present invention.

FIG. 3 illustrates a typical residential drinking water distribution system 7 equipped with a lead solubility control apparatus in accordance with the first embodiment of the present invention. Residence 8 is connected to water main 9 by pipe 2 in the form of lead-containing service lateral 10.

Lead control device 1 is small enough to permit insertion through the very small valve fitting that is typically located near the water meter connection and curb stop valves The water meter can be removed and the insertion device and water meter can be installed at that time. Removal of the water meter and closing of the curb stop will also allow for the easy insertion of the flushing equipment discussed above. Lead control device 1 is also stiff enough to permit insertion along the entire length of pipe 2. Spacers 5 of end portion 6 maintain wire 3 within pipe 2, restricting movement of wire 3 under turbulent conditions.

Wire 3 is inserted into pipe 2 through a drilled clamp type fitting on the service lateral 10. Wire 3 can be installed in service lateral 10 as a hot tap (under full water pressure), further enhancing the versatility of the invention. Power to wire 3 is supplied by a rectifier 11 connected to the electrical system of residence 8.

Wire 3 should extend substantially the entire estimated length of lead-containing service lateral 10. Wire 3 will seek its own position within the pipe, and all positions are equally acceptable in such a confined environment.

Utilizing impressed DC current for cathodic protection in accordance with the present invention also controls water-solubility of lead present in solder for copper pipes and in lead-containing brass fixtures. Where concerns for lead control have given rise to sufficiently strict limits on lead containing solder for copper pipes, the partially insulated wire would be inserted in the same manner as for lead-containing pipes, with an appropriate adjustment of current and voltage necessary to address the longer lengths and additional surface area typical of copper piping.

Further complicating the issues of lead pipe corrosion are the formation of lead oxide/hydroxy carbonate scales on the pipe walls. These scales are nonconductive and interfere with cathodic protection. Moreover, these scales are more soluble than the WHO minimum requirements set forth above, and pose a health risk.

Normally, a water piping system and water remain in the "Passivation" zone of FIG. 1, which is where the lead carbonate scales are formed on the surface of the pipe. Pipes or fittings already in use inevitably develop this carbonate-hydroxy lead scale. This scale is nonconductive and must be chemically removed in order to enable the cathodic protection to be completely effective. This scale has its own lead solubility that is not affected by the protection from the cathodic system, and which would likely cause the lead solubility to exceed the WHO standard of 10 ppb.

Thus, control of lead solubility in accordance with the present invention may include two steps. First, the scale must be removed by chemical washing to expose the uncharged metallic lead pipe wall. Second, the pipe wall must be immediately protected by cathodic protection. Of course, newly introduced lead containing fixtures would not have a scale formed and can be protected immediately by the use of cathodic protection.

In order to strip accumulated lead carbonate scaling and provide a bare metal surface for cathodic protection, the lead piping may first be washed with either very low pH or very high pH solution. As shown in FIG. 1, the pipe must then be kept in the "Immunity" range in order to assure that lead concentrations will remain within acceptable standards.

The partially insulated wire of the device should be stiff enough to allow for insertion and retrieval of an inflatable device combined with a chemical insertion tube used to add the acidic (or basic) chemicals for scale removal. Once cleaning has been completed, the remaining basic or acidic chemical wash can be flushed from the lead pipe, filtered to remove any lead, and then disposed of in sewer lines.

Figure 4:
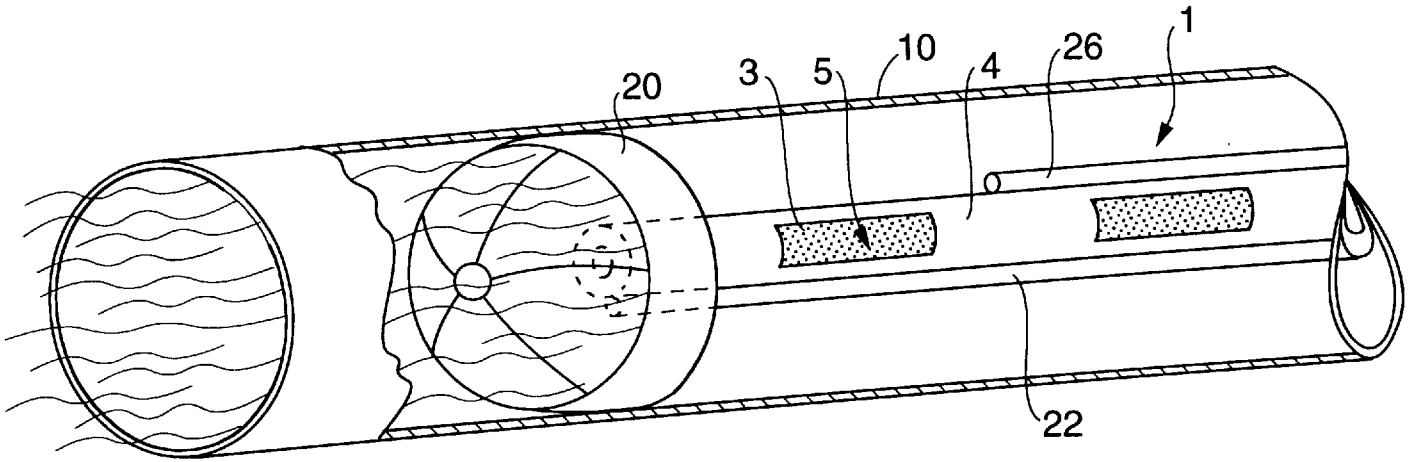
FIG. 4 shows an apparatus for lead control via in situ cathodic protection of lead piping in accordance with the present invention which includes pipe cleaning/scale removing features.

FIG. 4 shows an apparatus for lead control via in situ cathodic protection of lead piping in accordance with the present invention, which includes pipe cleaning/scale removing features. As in FIG. 2, lead control device 1 positioned within pipe 2 includes wire 3 partially encased by insulation 4.

Fixed to wire 3 is an inflatable attachment 20 which functions in a manner similar to that of an angioplasty device as used in heart surgery. Specifically, air fed to inflatable attachment 20 through inflation tube 22 causes attachment 20 to inflate and substantially plug the flow of water through pipe 2. Small water leaks through attachment 20 would be bled off easily through a lead removal filtration device (not shown) so that the waste water can be safely discharged to a sewer system or septic tank. One example of such a lead removal filtration device would be a small reverse osmosis unit.

Once the water flow is blocked by inflated attachment 20, the cleaning chemical (acid or base) can be introduced into the pipe through cleaning tube 26 and then recirculated to provide an aggressive cleaning environment. Once the cleaning chemical has had an opportunity to remove the scaling, any residual cleaning solutions would then be flushed out and filtered as described above prior to disposal. The inflatable device could then be deflated and retracted.

Although the invention has been described in FIGS. 2–4 in connection with specific embodiments, it should be understood that the invention as claimed should not be limited to this specific embodiment. Various other modifications and alterations in the structure and method of operation of this invention will be apparent to those skilled in the art without departing from the scope of the present invention.

For example, a second embodiment of the present invention teaches cathodic protection of lead-containing water vessels utilizing a sacrificial anode. In this second embodiment, no external current is impressed and supplied to the inserted conducting element. Instead, the inserted element naturally corrodes in the water to generate an oxidation potential sufficient to provide cathodic protection of the lead-containing walls of the fixture. In order to function properly, the composition of the inserted element must be carefully selected to ensure that its dissolution in the water will generate an oxidation potential greater than that associated with corrosion of the lead-containing walls in the water.

Figure 5:
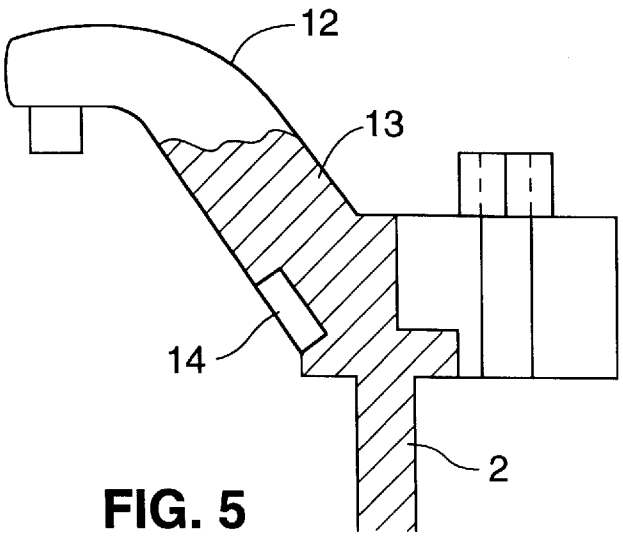
FIG. 5 shows a faucet equipped with a sacrificial anode in accordance with a second embodiment of the present invention.

FIG. 5 shows a faucet equipped with such a sacrificial magnesium anode in accordance with a second embodiment of the present invention. Faucet 12 is connected to pipe 2 by a valve. Current faucet designs allow some water to pool at the valve, creating water pool 13.

Older faucet valves contained significant amounts of lead, and even modern domestic "lead free" valves can contain as much as 8% lead. Therefore, water pool 13 can become contaminated with lead even where the water flow reaching faucet 12 is substantially lead free.

In the second embodiment of the lead control apparatus of the present invention, sacrificial anode 14 is inserted into faucet 12. Sacrificial anode 14 provides cathodic protection for lead-containing portions of faucet 12 that are in contact with water pool 13.

In order for sacrificial anode 14 to successfully prevent lead contamination, sacrificial anode 14 must itself corrode to generate a negative electrical potential on the lead-containing piping. Materials suitable for use as sacrificial anode 14 must thus possess a sufficiently high oxidation potential such that their corrosion produces this result. Materials suitable for use as sacrificial anode 14 must also dissolve in water to produce a product that is not harmful to human health. Therefore, sacrificial anode 14 is preferably composed of magnesium due to concerns over water quality degradation by metals other than magnesium. Thus while aluminum and zinc exhibit the necessary oxidation potential, these elements are less desirable materials for sacrificial anode 14 due to potential health and water quality concerns.

The size of the sacrificial anode is a function of the water conductivity (the amount of dissolved salt in the water), and also the surface area to be protected. Current densities similar to those used in the impressed current systems ($\approx 10\ \mu A/ft^2$) are required to protect the lead containing surfaces. The size of the anode is then controlled by the Nernst Equation, which relates the quantity of materials (mass) required to provide the current flow needed to protect the fixture. The last factor in establishing the size of the anode is the desired frequency of replacement. Annually would be the likely minimum frequency of replacement, although a larger anode would result in less frequent replacement.

It is possible to retrofit lead-containing fixtures such as faucets with a replaceable sacrificial anode. For new fixtures however, sacrificial anodes could be installed with threaded connections into specially designed fittings positioned at unobtrusive locations on the valves, to also permit easy access for routine replacement.

It is intended that the following claims define the scope of the invention, and that methods and structures within the scope of these claims and their equivalents be covered thereby.

What is claimed is:

1. An apparatus for cathodic protection of an internal surface of previously installed lead-containing water piping against corrosion, the apparatus comprising:

an electrically conducting element located in an interior volume defined by the internal surface of the previously installed water piping and having an impressed DC current which imposes a first potential on the internal surface that is negative relative to a second potential on the conducting element, such that the conducting element functions as an anode and the lead-containing water piping functions as a cathode, thereby cathodically protecting the internal surface from corrosion.

2. The apparatus according to claim 1, wherein the conducting element is a metal wire having a first end positioned within the water piping and a second end positioned outside of the water piping and connected to a DC power supply.

3. The apparatus according to claim 2, wherein the metal wire is composed of a metal selected from the group consisting of platinum, titanium-plated platinum, or silver-plated copper.

4. An apparatus for control of lead contamination of water caused by corrosion of the lead-containing walls of a water vessel, the apparatus comprising:

a conducting element inserted within the lead-containing vessel, the conducting element imposing first voltage on the lead containing walls, the first voltage being negative relative to a second voltage on the conducting element, such that the conducting element acts as an anode and the lead-containing walls act as a cathode.

5. The lead control apparatus according to claim 4, wherein the lead-containing vessel is a water pipe, the conducting element is a metal wire inserted within the water pipe, and the metal wire is connected to a DC power supply.

6. The lead control apparatus according to claim 5, wherein the metal wire is composed of a metal selected from the group consisting of platinum, titanium-plated platinum, and silver-plated copper.

7. A method for preventing corrosion of an internal surface of previously-installed lead-containing water piping, the method comprising the steps of:

introducing an electrically conducting element within an interior volume defined by the internal surface; and applying a DC current to the electrically conducting element such that the internal surface bears a first voltage negative relative to a second voltage on the electrically conducting element.

8. The method according to claim 7 wherein the step of applying a DC current to the electronically conducting element includes applying a DC current to the electronically conducting element sufficient to impose a voltage of less than about −0.3 V on the water piping.

9. The method according to claim 7, further comprising the steps of:

blocking a flow of water through the lead-containing water piping;

introducing a cleaning agent into the lead-containing water piping to remove lead carbonate scales from the water piping;

removing the cleaning agent from the lead-containing water piping; and unblocking the flow of water through the lead-containing piping.

10. The method according to claim 9 wherein:

the step of blocking a flow of water includes pumping air into an inflatable attachment fixed to the electrically conducting element;

the step of removing the cleaning agent from the lead containing water piping further includes, flushing the piping with water and filtering the cleaning agent and the water to remove lead, and flowing the filtered water into a sewer; and the step of unblocking a flow of water includes deflating the inflatable attachment.

11. An apparatus for cathodic protection of previously installed lead-containing water piping against corrosion, the apparatus comprising:

a metal wire having a first end located in the water piping and a second end outside of the water piping, the second end being connected to a DC power supply and bearing an impressed DC current which imposes a negative potential of below −0.3 V on the lead-containing water piping, such that the conducting element functions as an anode and the lead-containing water piping functions as a cathode, thereby cathodically protecting the lead-containing water piping from corrosion;

an inflatable attachment fixed to the first end of the metal wire; and an inflation tube having a first end and a second end, the first end connected to the inflatable attachment and the second end positioned outside of the water piping.

12. The apparatus according to claim 11, further comprising:

a cleaning tube having a first end fixed proximate to the first end of the wire and a second end protruding from the piping, such that a cleaning agent may be pumped into the second end of the cleaning tube and flow out of the first end of the cleaning tube.

13. An apparatus for cathodic protection of an internal surface of previously installed lead-containing water piping against corrosion, the apparatus comprising:

a metal wire extending within the lead-containing water piping for substantially an entire estimated length of the lead-containing water piping, the metal wire resistant to dissolution and having a first end and a second end, the second end positioned outside the pipe; and a power supply attached the second end of the wire, such that the metal wire bears an impressed DC current which imposes a negative potential on the lead-containing water piping such that the metal wire functions as an anode and the lead-containing water piping functions as a cathode, thereby cathodically protecting the lead containing water piping from corrosion.

14. The apparatus of claim 13 wherein the metal wire is composed of a metal selected from the group consisting of platinum, titanium-plated platinum and silver plated copper.

15. The apparatus of claim 13 wherein the wire is partially encased by insulation.

16. A method for preventing corrosion of an internal surface of previously-installed lead-containing water piping, the method comprising the steps of:

estimating the length of the previously-installed lead-containing water piping;

inserting a metal wire into the previously-installed lead-containing water piping, such that the metal wire extends inside the lead-containing water piping substantially along the entire estimated length of the lead containing water piping and such that one end of the wire remains outside of the pipe;

connecting the end of the wire which is outside the pipe to a power supply and applying an impressed DC current which imposes a negative potential on the lead-containing water piping such that the metal wire functions as an anode and the lead-containing water piping functions as a cathode, thereby cathodically protecting the lead-containing water piping from corrosion.

17. The method of claim 16 wherein the metal wire is partially encased by insulation.

* * * * *

UNITED STATES PATENT AND TRADEMARK OFFICE

CERTIFICATE OF CORRECTION

PATENT NO. : 6,103,097
DATED : August 15, 2000
INVENTOR(S) : Larry L. Russell

It is certified that error appears in the above-identified patent and that said Letters Patent is hereby corrected as shown below:

Column 4,
Lines 37-38, delete “titanium-plated platinum” and insert therefor -- platinum-plated titanium --

Column 7,
Line 66, delete “titanium-plated platinum” and insert therefor -- platinum-plated titanium --

Column 8,
Line 16, delete “titanium-plated platinum” and insert therefor -- platinum-plated titanium --

Column 10,
Line 3, delete “titanium-plated platinum” and insert therefor -- platinum-plated titanium --

Signed and Sealed this

Twenty-first Day of June, 2005

JON W. DUDAS
*Director of the United States Patent and Trademark Office*